US012635844B2

(12) United States Patent
Ariza et al.

(10) Patent No.: US 12,635,844 B2
(45) Date of Patent: May 26, 2026

(54) DISHWASHING APPLIANCE AND COMMUNICATION-BASED OPERATION THEREOF

(71) Applicant: Haier US Appliance Solutions, Inc., Wilmington, DE (US)

(72) Inventors: Kevin Ariza, Miami, FL (US); Irena J. McDowell, Louisville, KY (US); Angie Baca, Louisville, KY (US); Kevin Foushee, Louisville, KY (US); Joel McElwee, Louisville, KY (US); Riley Dickson, West Lafayette, FL (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 41 days.

(21) Appl. No.: 18/659,271

(22) Filed: May 9, 2024

(65) Prior Publication Data

US 2025/0344930 A1 Nov. 13, 2025

(51) Int. Cl.
*A47L 15/00* (2006.01)

(52) U.S. Cl.
CPC ..... *A47L 15/0063* (2013.01); *A47L 15/0007* (2013.01); *A47L 15/0065* (2013.01); *A47L 2401/04* (2013.01); *A47L 2401/34* (2013.01); *A47L 2501/06* (2013.01); *A47L 2501/07* (2013.01); *A47L 2501/30* (2013.01)

(58) Field of Classification Search
CPC ..... H04L 12/2803
See application file for complete search history.

(56) References Cited

U.S. PATENT DOCUMENTS

| | | | | |
|---|---|---|---|---|
| 10,722,096 | B2 | 7/2020 | Gary et al. | |
| 11,352,729 | B2 | 6/2022 | Kessler et al. | |
| 2016/0213033 | A1* | 7/2016 | Kim | A23L 5/10 |
| 2016/0231723 | A1* | 8/2016 | Pietsch | A47L 15/0063 |
| 2019/0301923 | A1* | 10/2019 | Barreto | F25D 23/00 |
| 2020/0085275 | A1 | 3/2020 | Lee | |
| 2020/0093347 | A1* | 3/2020 | Shashidhar | A47L 15/449 |
| 2020/0214474 | A1* | 7/2020 | Ryu | G07F 9/023 |
| 2020/0305678 | A1* | 10/2020 | Kessler | A47L 15/0021 |
| 2022/0392011 | A1 | 12/2022 | Lee et al. | |

FOREIGN PATENT DOCUMENTS

| | | | |
|---|---|---|---|
| BR | 102019006468 | A2 | 10/2019 |
| CN | 106419785 | A * | 2/2017 |
| CN | 106419785 | B | 4/2019 |
| CN | 113243866 | A | 8/2021 |
| KR | 102498377 | B1 | 2/2023 |

* cited by examiner

*Primary Examiner* — Kaj K Olsen
*Assistant Examiner* — Richard Z. Zhang
(74) *Attorney, Agent, or Firm* — Dority & Manning, P.A.

(57) ABSTRACT

A method of operating a dishwashing appliance includes receiving, at an external device, an input indicative of a characterization of a load of items inside an other appliance and determining a change in the characterization the load of items inside the other appliance based on the received input. The method also includes operating a wash cycle of the dishwashing appliance in response to the change in the characterization of the load of items inside the other appliance.

18 Claims, 8 Drawing Sheets

DISHWASHING APPLIANCE AND COMMUNICATION-BASED OPERATION THEREOF

FIELD OF THE INVENTION

The present subject matter relates generally to dishwashing appliances, and more particularly to methods for operating a dishwashing appliances via signal-based communication with one or more other appliances.

BACKGROUND OF THE INVENTION

Dishwashing appliances generally include a tub that defines a wash chamber. Rack assemblies can be mounted within the wash chamber of the tub for receipt of articles for washing. Multiple spray assemblies can be positioned within the wash chamber for applying or directing wash liquid (e.g., water, detergent, etc.) towards articles disposed within the rack assemblies in order to clean such articles. Dishwashing appliances are also typically equipped with one or more pumps, such as a circulation pump or a drain pump, for directing or motivating wash liquid from the sump to, e.g., the spray assemblies or an area outside of the dishwashing appliance.

In order to facilitate cleaning of articles in a dishwashing appliance, chemical additives such as cleaning agents or other similar additives are used. During operation of the dishwashing appliance, the additives generally mix with water in the wash compartment to form a wash liquid that is used to clean articles within the wash compartment. Wash additives include, for example, detergents and rinse agents. In some cases, liquid wash additives are used.

However, not all operations, or cycle options, of the dishwashing appliance include wash additives. In some scenarios, certain glassware or other articles may benefit from wash additives to provide a better clean or shine. Accordingly, improved methods for suggesting operations of dishwashing appliance would be useful.

BRIEF DESCRIPTION OF THE INVENTION

Aspects and advantages of the invention will be set forth in part in the following description, or may be obvious from the description, or may be learned through practice of the invention.

In one example embodiment, a method of operating a dishwashing appliance is provided. The method includes determining, by an external device, registration of an other appliance and the dishwashing appliance. The method also includes characterizing a load of items inside the other appliance and determining a change in the characterization of the load of items inside the other appliance. The method further includes operating a wash cycle of the dishwashing appliance in response to the change in the characterization of the load of items inside the other appliance.

In another example embodiment, a method of operating a dishwashing appliance is provided. The method includes receiving, at an external device, an input indicative of a characterization of a load of items inside an other appliance and determining a change in the characterization the load of items inside the other appliance based on the received input. The method also includes operating a wash cycle of the dishwashing appliance in response to the change in the characterization of the load of items inside the other appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
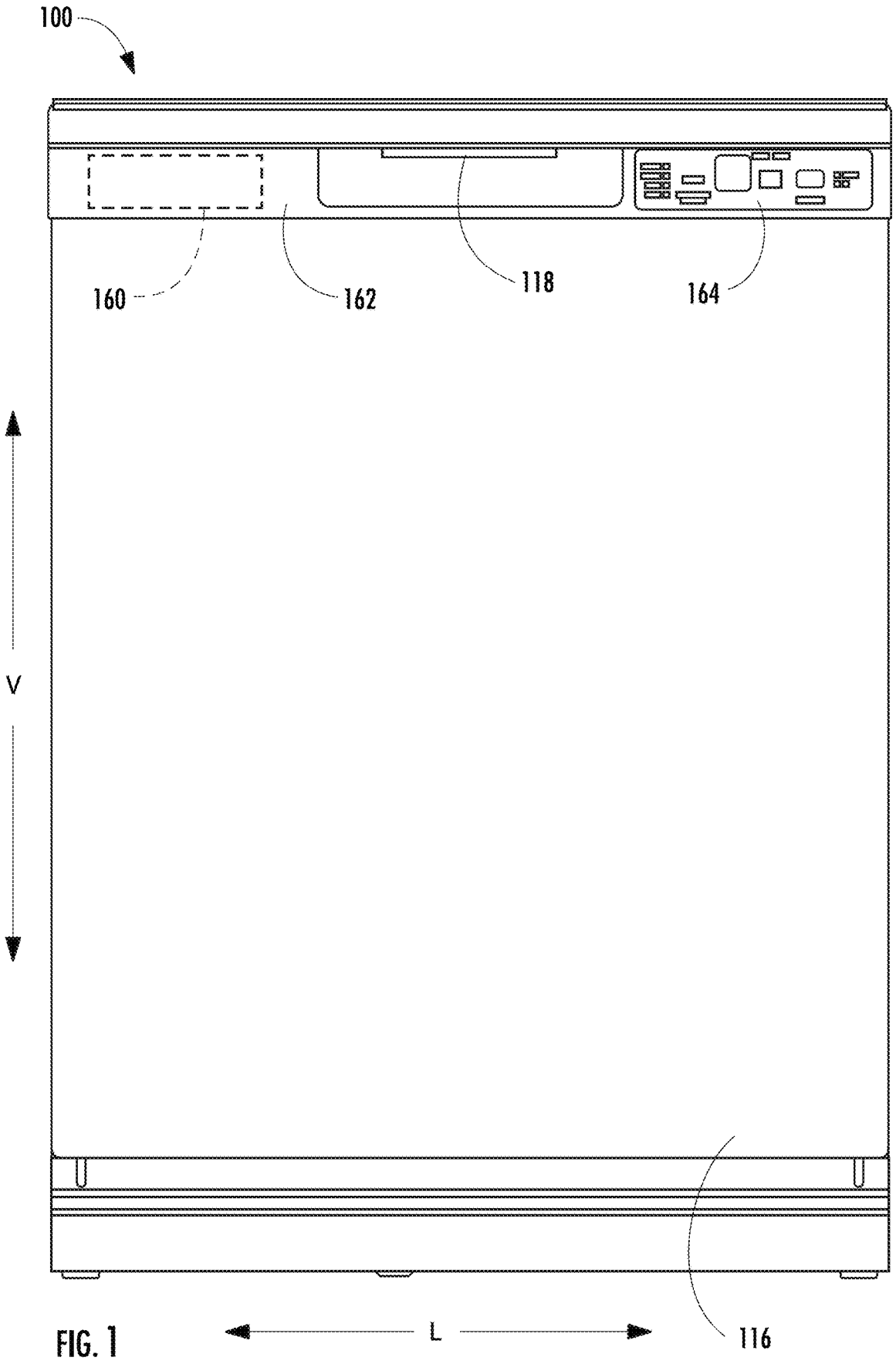
FIG. 1 provides a front view of an example embodiment of a dishwashing appliance of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. The detailed description uses numerical and letter designations to refer to features in the drawings. Like or similar designations in the drawings and description have been used to refer to like or similar parts of the disclosure. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is used to refer to an overall operation of the dishwashing appliance which may include two or more distinct phases. The term "wash phase" is intended to refer to one or more periods of time during which a dishwashing appliance operates while containing the articles to be washed and uses a wash liquid (e.g., water, detergent, or wash additive) and may be a portion of the wash cycle, such as a beginning or early portion of the wash cycle. The term "rinse phase" is intended to refer to one or more periods of time during which the dishwashing appliance operates to remove residual soil, detergents, and other undesirable elements that were retained by the articles after completion of the wash phase and may be a portion of the wash cycle, such as an intermediate portion of the wash cycle. The term "drain phase" is intended to refer to one or more periods of time during which the dishwashing appliance operates to discharge soiled water from the dishwashing appliance and may be a portion of the wash cycle, such as a later portion of the wash cycle. The term "wash liquid" refers to a liquid used for washing or rinsing the articles that is typically made up of water and may include additives, such as detergent or other treatments (e.g., rinse aid). Furthermore, as used herein, terms of approximation, such as "generally," "approximately," "substantially," or "about," refer to being within a ten percent (10%) margin of error. When used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
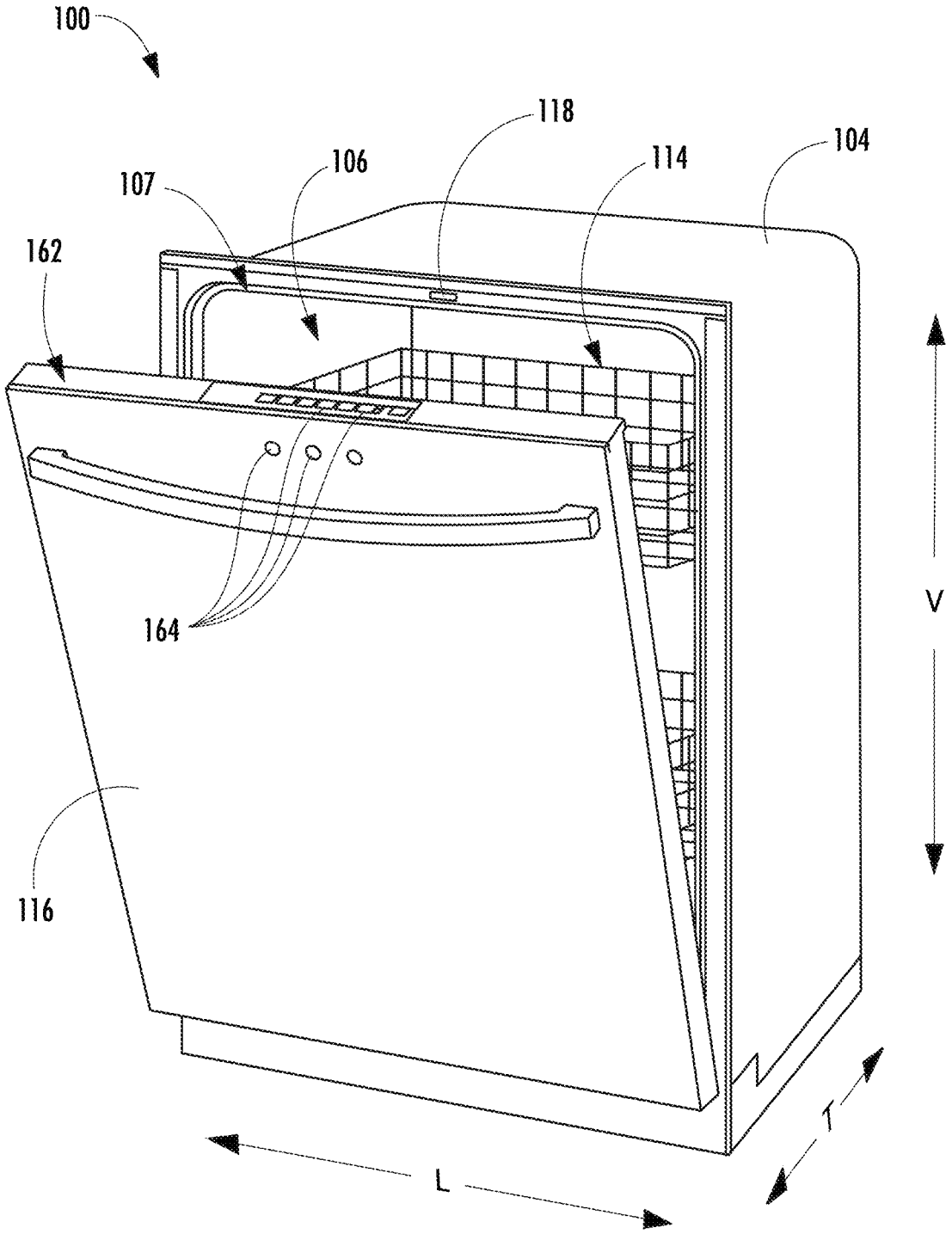
FIG. 2 provides a perspective view of an additional example embodiment of a dishwashing appliance of the present disclosure with a door in an intermediate position.
Figure 3:
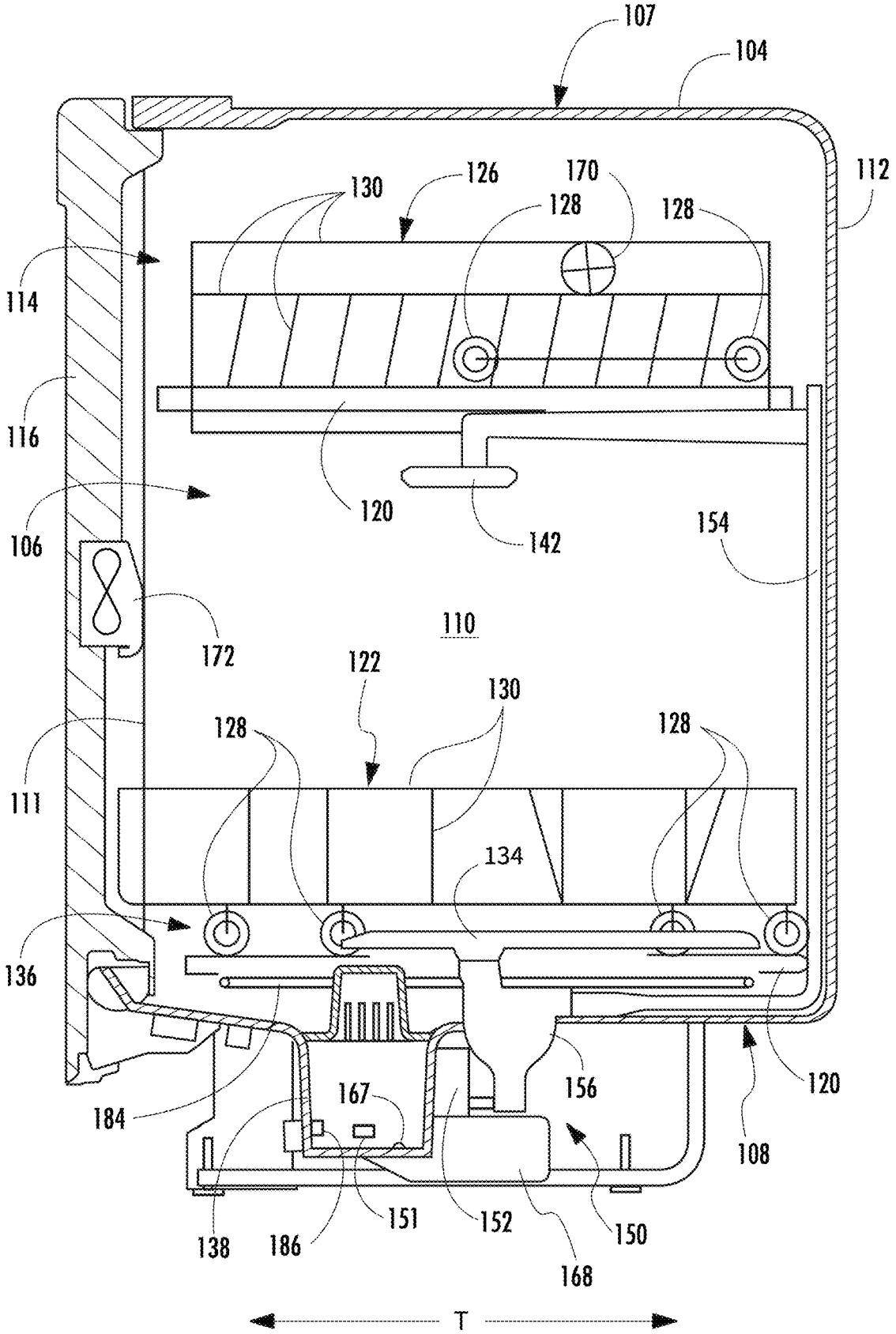
FIG. 3 provides a side, cross section view of an example dishwashing appliance, such as the dishwashing appliance of FIG. 1 or FIG. 2.

Turning now to the figures, FIGS. 1 through 3 depict an example dishwasher or dishwashing appliance (e.g., dishwashing appliance 100) that may be configured in accordance with aspects of the present disclosure. Generally, dishwashing appliance 100 defines a vertical direction V, a lateral direction L, and a transverse direction T. Each of the vertical direction V, lateral direction L, and transverse direction T are mutually perpendicular to one another and form an orthogonal direction system.

Dishwashing appliance 100 includes a tub 104 that defines a wash chamber 106 therein. As shown in FIG. 3, tub 104 extends between a top 107 and a bottom 108 along the vertical direction V, between a pair of side walls 110 along the lateral direction L, and between a front side 111 and a rear side 112 along the transverse direction T.

Tub 104 includes a front opening 114 at the front side 111. In some embodiments, the dishwashing appliance 100 may also include a door 116 at the front opening 114. The door 116 may, for example, be coupled to the tub 104 by a hinge (not shown) at its bottom for movement between a normally closed vertical position (FIGS. 1 and 3), wherein the wash chamber 106 is sealed shut for washing operation, and a horizontal open position (not shown) for loading and unloading of articles from dishwashing appliance 100. A door closure mechanism or assembly 118, e.g., a latch, may be provided to lock and unlock door 116 for accessing and sealing wash chamber 106.

In example embodiments, tub side walls 110 accommodate a plurality of rack assemblies. For instance, guide rails 120 may be mounted to side walls 110 for supporting a lower rack assembly 122 and an upper rack assembly 126. In some such embodiments, upper rack assembly 126 is positioned at a top portion of wash chamber 106 above lower rack assembly 122 along the vertical direction V.

Generally, each rack assembly 122, 126 may be adapted for movement between an extended loading position (not shown) in which the rack is substantially positioned outside the wash chamber 106, and a retracted position (shown in FIGS. 1 through 3) in which the rack is located inside the wash chamber 106. In some embodiments, movement is facilitated, for instance, by rollers 128 mounted onto rack assemblies 122, 126, respectively.

Although guide rails 120 and rollers 128 are illustrated herein as facilitating movement of the respective rack assemblies 122, 126, it should be appreciated that any suitable sliding mechanism or member may be used according to alternative embodiments.

In optional embodiments, some or all of the rack assemblies 122, 126 are fabricated into lattice structures including a plurality of wires or elongated members 130 (for clarity of illustration, not all elongated members making up rack assemblies 122, 126 are shown). In this regard, rack assemblies 122, 126 are generally configured for supporting articles within wash chamber 106 while allowing a flow of wash liquid to reach and impinge on those articles (e.g., during a cleaning or rinsing phase of the wash cycle). According to additional or alternative embodiments, a silverware basket (not shown) may be removably attached to a rack assembly (e.g., lower rack assembly 122), for placement of silverware, utensils, and the like, that are otherwise too small to be accommodated by the rack assembly.

Generally, dishwashing appliance 100 includes one or more spray assemblies for urging a flow of fluid (e.g., wash liquid) onto the articles placed within wash chamber 106.

In example embodiments, dishwashing appliance 100 includes a lower spray arm assembly 134 disposed in a lower region 136 of wash chamber 106 and above a sump 138 so as to rotate in relatively close proximity to lower rack assembly 122. In this regard, lower spray arm assembly 134 may generally be configured for urging a flow of wash liquid up through lower rack assembly 122.

In some embodiments, an upper spray assembly 142 may be located proximate to and, e.g., below, upper rack assembly 126 along the vertical direction V. In this manner, upper spray assembly 142 may be generally configured for urging of wash liquid up through upper rack assembly 126.

The various spray assemblies and manifolds described herein may be part of a fluid distribution system or fluid circulation assembly 150 for circulating wash liquid in tub 104. In certain embodiments, fluid circulation assembly 150 includes a circulation pump 152 for circulating wash liquid in tub 104. Circulation pump 152 may be mounted to sump 138 and in fluid communication with the sump 138 through a circulation outlet 151 from the sump 138.

When assembled, circulation pump 152 may be in fluid communication with an external water supply line (not shown) and sump 138. A water inlet valve (not shown) can be positioned between the external water supply line and circulation pump 152 (e.g., to selectively allow water to flow from the external water supply line to circulation pump 152). Additionally or alternatively, water inlet valve can be positioned between the external water supply line and sump 138 (e.g., to selectively allow water to flow from the external water supply line to sump 138). During use, water inlet valve may be selectively controlled to open to allow the flow of water into dishwashing appliance 100 and may be selectively controlled to close and thereby cease the flow of water into dishwashing appliance 100. Further, fluid circulation assembly 150 may include one or more fluid conduits or circulation piping for directing wash fluid from circulation pump 152 to the various spray assemblies and manifolds. In example embodiments, such as that shown in FIG. 3, a primary supply conduit 154 extends from circulation pump 152, along rear side 112 of tub 104 along the vertical direction V to supply wash liquid throughout wash chamber 106.

In optional embodiments, circulation pump 152 urges or pumps wash liquid to a diverter 156 (FIG. 3). In some such embodiments, diverter 156 is positioned within sump 138 of dishwashing appliance 100). Diverter 156 may include a diverter disk (not shown) disposed within a diverter chamber for selectively distributing the wash liquid to the spray assemblies 134, 142, or other spray manifolds or assemblies. For instance, the diverter disk may have at least one aperture configured to align with one or more outlet ports (not shown) at the top of the diverter chamber. In this manner, the diverter disk may be selectively rotated to provide wash liquid to the desired spray device(s).

In example embodiments, diverter 156 is configured for selectively distributing the flow of wash liquid from circulation pump 152 to various fluid supply conduits—only some of which are illustrated in FIG. 3 for clarity. In certain embodiments, diverter 156 includes two or more outlet ports (not shown) for supplying wash liquid to a first conduit for rotating lower spray arm assembly 134 and a second conduit for supplying upper spray assembly 142 (e.g., supply conduit 154). Additional embodiments may also include one or more additional conduits, e.g., a third conduit for spraying an auxiliary rack such as a silverware rack, etc.

In some embodiments, a supply conduit 154 is used to supply wash liquid to one or more spray assemblies (e.g., to upper spray assembly 142). It should be appreciated, however, that according to alternative embodiments, any other suitable plumbing configuration may be used to supply wash liquid throughout the various spray manifolds and assemblies described herein. For instance, according to another example embodiment, supply conduit 154 could be used to provide wash liquid to lower spray arm assembly 134 and a dedicated secondary supply conduit (not shown) could be utilized to provide wash liquid to upper spray assembly 142. Other plumbing configurations may be used for providing wash liquid to the various spray devices and manifolds at any location within dishwashing appliance 100.

Each spray assembly 134 and 142, or other spray device as may be included in dishwashing appliance 100, may include an arrangement of discharge ports or orifices for directing wash liquid received from circulation pump 152 onto dishes or other articles located in wash chamber 106. The arrangement of the discharge ports, also referred to as jets, apertures, or orifices, may provide a rotational force by virtue of wash liquid flowing through the discharge ports. Alternatively, spray assemblies 134, 142 may be motor-driven, or may operate using any other suitable drive mechanism. Spray manifolds and assemblies may also be stationary. The resultant movement of the spray assemblies 134, 142 and the spray from fixed manifolds provides coverage of dishes and other dishwasher contents with a washing spray. Other configurations of spray assemblies may be used as well. For instance, dishwashing appliance 100 may have additional spray assemblies for cleaning silverware, for scouring casserole dishes, for spraying pots and pans, for cleaning bottles, etc.

Drainage of soiled wash liquid within sump 138 may by provided, for instance, by a drain pump 168 (e.g., during or as part of a drain phase). In particular, wash liquid may exit sump 138 through a drain outlet 167 and may flow through a drain conduit or directly to the drain pump 168. Thus, drain pump 168 is downstream of sump 138 and facilitates drainage of the soiled wash liquid by urging or pumping the wash liquid to a drain line external to dishwashing appliance 100.

In some embodiments, a filter assembly may be provided, e.g., in the sump 138 and/or at a top entrance into the sump 138, e.g., to filter fluid to circulation assembly 150 and/or drain pump 168. Generally, the filter assembly removes soiled particles from the liquid that flows to the sump 138 from the wash chamber 106 during operation of dishwashing appliance 100. In example embodiments, the filter assembly may include both a first filter (also referred to as a "coarse filter") and a second filter (also referred to as a "fine filter").

Although a separate circulation pump 152 and drain pump 168 are described herein, it is understood that other suitable pump configurations (e.g., using only a single pump for both recirculation and draining) may be provided.

The dishwashing appliance 100 may further include a heating element 184, such as a resistance heating element, positioned in or near the sump 138. For example, the heating element 184 may be positioned "near" the sump 138 in that the heating element 184 is disposed above the sump 138 and within the lower region 136 of wash chamber 106, such as below the lower spray arm 134 and/or below the lower rack assembly 122. The heating element 184 may be positioned and configured to heat liquid in the sump 138, such as for a heated wash phase, and/or to heat air within the wash chamber 106, such as for drying articles during a dry phase.

Dishwashing appliance 100 may also include ventilation features, e.g., to promote improved, e.g., more rapid, drying of articles therein after the wash and rinse phases. For example, one or more vents 170 may be provided in the tub 104 for introducing relatively dry air from outside of the tub 104 into the wash chamber 106 and/or for removing relatively humid air from the wash chamber 106 to the outside of the tub 104. In some embodiments, a fan 172 may be provided. The fan 172 may be operable to urge air through the wash chamber 106, such as to promote air circulation and/or ventilation within and through the wash chamber. Such air movement may increase the rate of evaporation of moisture from articles in the wash chamber 106 after a wash and/or rinse phase.

In certain embodiments, dishwashing appliance 100 includes a controller 160 configured to regulate operation of dishwashing appliance 100 (e.g., initiate one or more wash operations). Controller 160 may include one or more memory devices and one or more microprocessors, such as general or special purpose microprocessors operable to execute programming instructions or micro-control code associated with a wash operation or wash cycle that may include a pre-wash phase, a wash phase, a rinse phase, a drain phase, and/or a dry phase. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor, e.g., using a combination of discrete analog or digital logic circuitry—such as switches, amplifiers, integrators, comparators, flip-flops, AND gates, and the like—to perform control functionality instead of relying upon software. It should be noted that controllers as disclosed herein are capable of and may be operable to perform any methods and associated method steps as disclosed herein.

Controller 160 may be positioned in a variety of locations throughout dishwashing appliance 100. In optional embodiments, controller 160 is located within a control panel area 162 of door 116 (e.g., as shown in FIG. 1 or FIG. 2). Input/output ("I/O") signals may be routed between the control system and various operational components of dishwashing appliance 100 along wiring harnesses that may be routed through the bottom of door 116. Typically, the controller 160 includes or is operatively coupled to a user interface panel/controls 164 through which a user may select various operational features and modes and monitor progress of dishwashing appliance 100. In some embodiments, user interface 164 includes a general purpose I/O ("GPIO") device or functional block. In additional or alternative embodiments, user interface 164 includes input components, such as one or more of a variety of electrical, mechanical, or electro-mechanical input devices including rotary dials, push buttons, and touch pads. In further additional or alternative embodiments, user interface 164 includes a display component, such as a digital or analog display device designed to provide operational feedback to a user. When assembled, user interface 164 may be in operative communication with the controller 160 via one or more signal lines or shared communication busses.

The dishwashing appliance 100 may also include a temperature sensor 186 in operative communication with the controller 160. For example, in some embodiments, the temperature sensor 186 may be located in the sump 138 and may thereby be operable to measure a temperature of a liquid, e.g., wash liquid, within the sump 138. For example, the "temperature sensor" may include any suitable type of temperature measuring system or device positioned at any suitable location for measuring the desired temperature. Thus, for example, temperature sensor 186 may be any suitable type of temperature sensor, such as a thermistor, a thermocouple, a resistance temperature detector, a semiconductor-based integrated circuit temperature sensor, etc. In addition, temperature sensor 186 may be positioned at any suitable location and may output a signal, such as a voltage, to the controller 160 that is proportional to and/or indicative of the temperature being measured. Although example positioning of the temperature sensor 186 is described herein and depicted in FIG. 3, it should be appreciated that dishwashing appliance 100 may include any other suitable number, type, and position of temperature, humidity, and/or other sensors as well as or instead of the example temperature sensor 186 according to alternative embodiments.

It should be appreciated that the present disclosure is not limited to any particular style, model, or configuration of dishwashing appliance 100. The example embodiments depicted in FIGS. 1 through 3 are for illustrative purposes only. For instance, different locations may be provided for control panel area 162 (e.g., on the front of the door 116 as illustrated in FIG. 1 or on the top of the door 116 as illustrated in FIG. 2, or other locations as well), different configurations may be provided for rack assemblies 122, 126, different spray assemblies 134, 142 and spray manifold configurations may be used, different sensors may be used, and other differences may be applied while remaining within the scope of the present disclosure.

Figure 4:
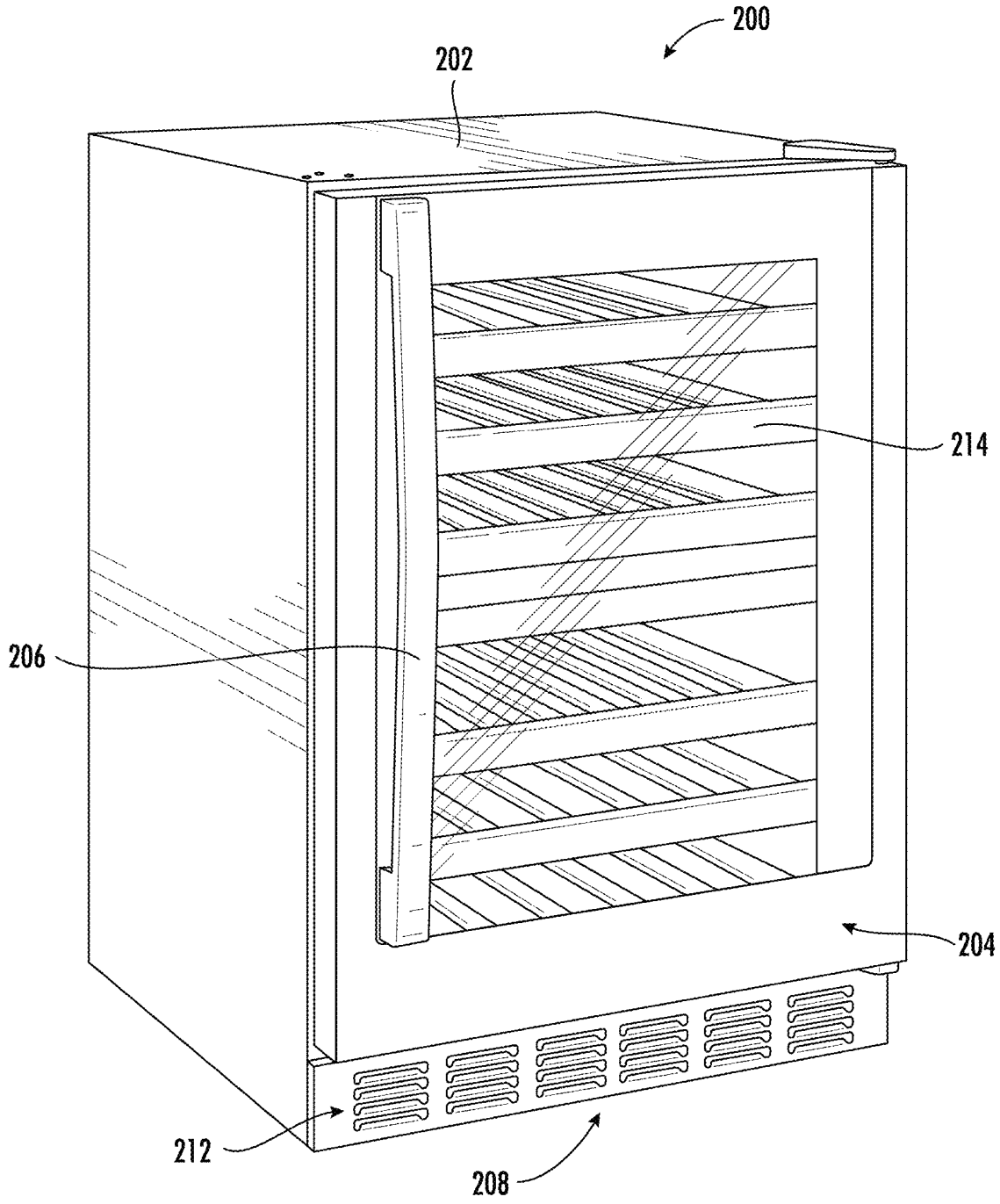
FIG. 4 provides a perspective view of an example embodiment of a refrigeration appliance in accordance with aspects of the present disclosure.
Figure 5:
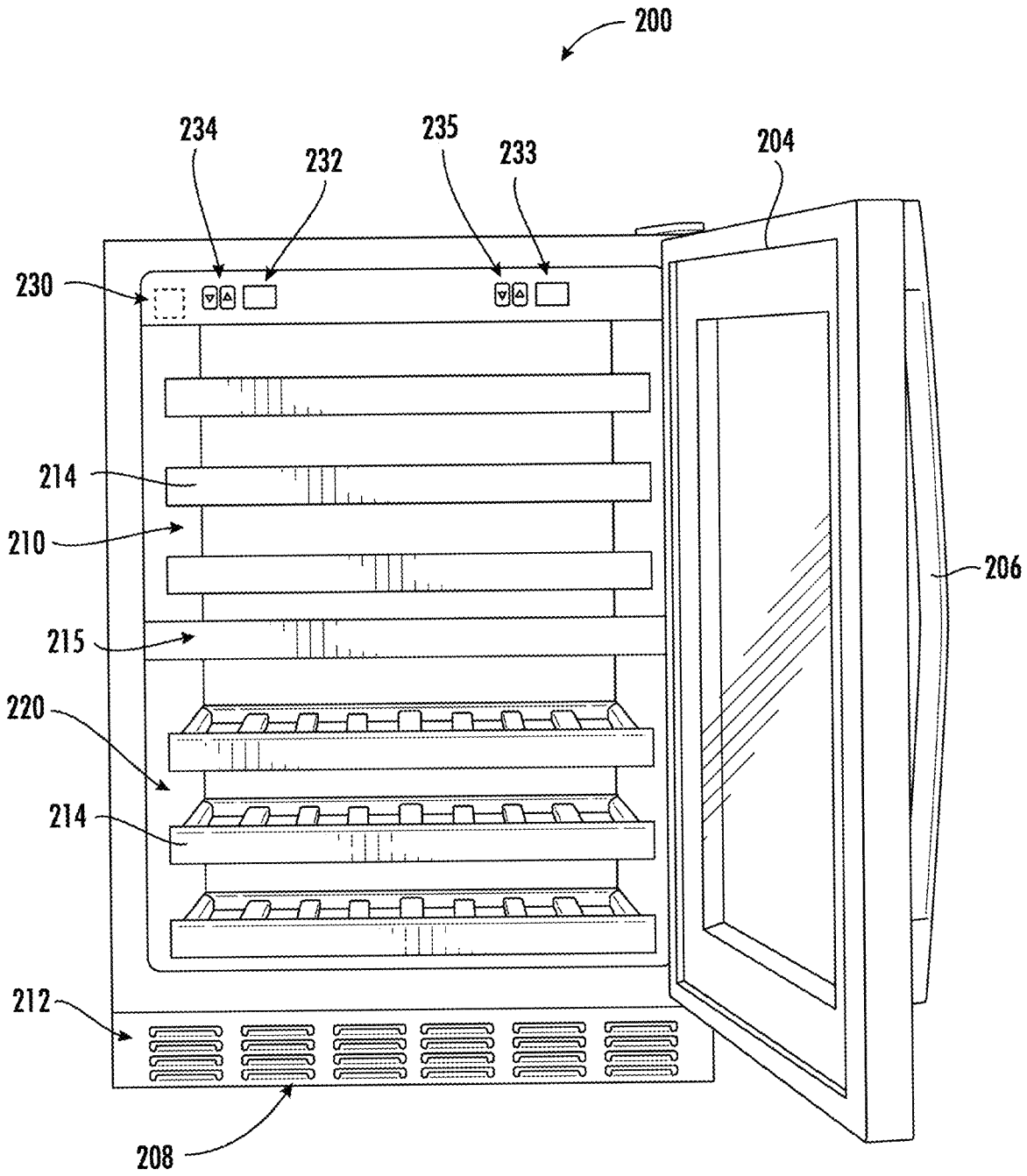
FIG. 5 provides a front view of an example embodiment of a refrigeration appliance in accordance with aspects of the present disclosure.

Referring now to FIG. 4, a perspective view of an embodiment of a refrigeration appliance 200 is provided. FIG. 5 provides a view of the refrigeration appliance 200 in which a door 204 is open to further depict an interior of the appliance 200. Referring to FIGS. 4-5, appliance 200 includes a cabinet 202 forming a plurality of cooling compartments in the interior, including a first compartment 210 thermally separate from the second compartment 220. Cabinet 202 includes a plurality of walls forming, at least in part, the plurality of cooling compartments. One or more trays 214 are positioned within the interior, such as at the compartments 210, 220. Tray 214 may be configured to hold one or more beverages. An interior compartment wall 215 may separate the first compartment 210 from the second compartment 220. A door 204 is attached to cabinet 202 and configured to open and close, e.g., via hinged attachment to cabinet 202, to allow access to compartments 210, 220. Door 204 may include a handle 206 at which a user may utilize, e.g., pull, to open and close door 204.

Appliance 200 includes a utility compartment 208 at which operational components (not shown) for cooling and distributing air or other cooling fluid may be disposed. In some embodiments, such as depicted in FIGS. 4-5, the utility compartment 208 is positioned at a bottom portion of cabinet 202, such as underneath the compartments 210, 220. In other embodiments, utility compartment 208 may be positioned at a back portion, a top portion, or a side portion of cabinet 202. In still some embodiments, utility compartment 208 may include vent openings 212 configured to allow fluid flow, e.g., air flow, or thermal communication of air at various components at the utility compartment 208, e.g., evaporators, condensers, fans, etc.

Referring to FIG. 5, appliance 200 includes a controller 230 configured to execute instructions that cause the appliance 200 to perform operations. Controller 230 is configured to regulate operation at the appliance 200. Controller 230 may be positioned in a variety of locations throughout appliance 200 (e.g., a control panel area at cabinet 202, at the door 204, etc.). In some embodiments, input/output ("I/O") signals are routed between controller 230 and the operational components of appliance 200, such as a heat exchanger system (not shown), a damper assembly (not shown), a flow control device (not shown), etc., along wiring harnesses that may be routed, e.g., through the cabinet 202. Alternatively, or in combination, signals may be communicated via wireless communications between controller 230 and various operation components of the appliance 200.

Controller 230 may include a user interface panel through which a user may select various operational features and operating modes and monitor progress of the appliance 200. The user interface may represent a general purpose I/O ("GPIO") device or functional block. Additionally, the user interface may include input components 234, such as one or more of a variety of electrical, mechanical, or electro-mechanical input devices including rotary dials, push buttons, and touch pads. The user interface may also include a display component 232, such as a digital or analog display device designed to provide operational feedback (e.g., compartment temperature, humidity, etc. to a user. The user interface may be in communication with the controller 230 via one or more signal lines or shared communication busses, such as wired or wireless communications devices.

Referring still to FIG. 5, the appliance 200 may be configured as a dual environment appliance at which a first environment is provided and controlled at the first compartment 210 and a second environment is provided and controlled at the second compartment 220. The environment, and control thereof, may include a temperature and/or humidity different and separately controlled from one another. Controller 230 may include a first input component 234 configured to adjust or modulate temperature or humidity at the first compartment 210 and a second input component 235 configured to adjust or modulate temperature or humidity at the second compartment 220. In general, first and second input components 234, 235 may be part of controller 230 or may be separate and thus connected via wires/wireless communication to controller 230. A first display component 232 may display environmental conditions (e.g., temperature, humidity) at the first compartment 210, and a second display component 233 may display environmental conditions at the second compartment 220. User controls may allow the user to toggle between current conditions at each compartment 210, 220 and set conditions to which the appliance 200 is targeting, e.g., temperature and/or humidity, relative to each compartment 210, 220. It should be appreciated that embodiments of the appliance 200 may include a single controller 230, display component 232, or input component 234 configured to toggle between current environmental conditions and set conditions between the first compartment 210 and the second compartment 220.

Controller 230 may include one or more processing devices and one or more memory devices. As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 230 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 230 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors, such as one or more steps of a method for operating an appliance such as provided herein. It should be appreciated that the instructions can be software written in any suitable programming language or can be implemented in hardware. Additionally, or alternatively, the instructions can be executed logically and/or virtually using separate threads on one or more processors. Executed instructions may cause an appliance to perform operations, such as one or more method steps, as provided further herein.

Controller 230 may include a wired or wireless communications device configured to send or receive instructions e.g., through a network, such as, but not limited to, a local area network (LAN), a wide area network (WAN), a personal area network (PAN), the Internet, a cellular network, or any suitable short-or long-range networks, etc. Communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

Figure 6:
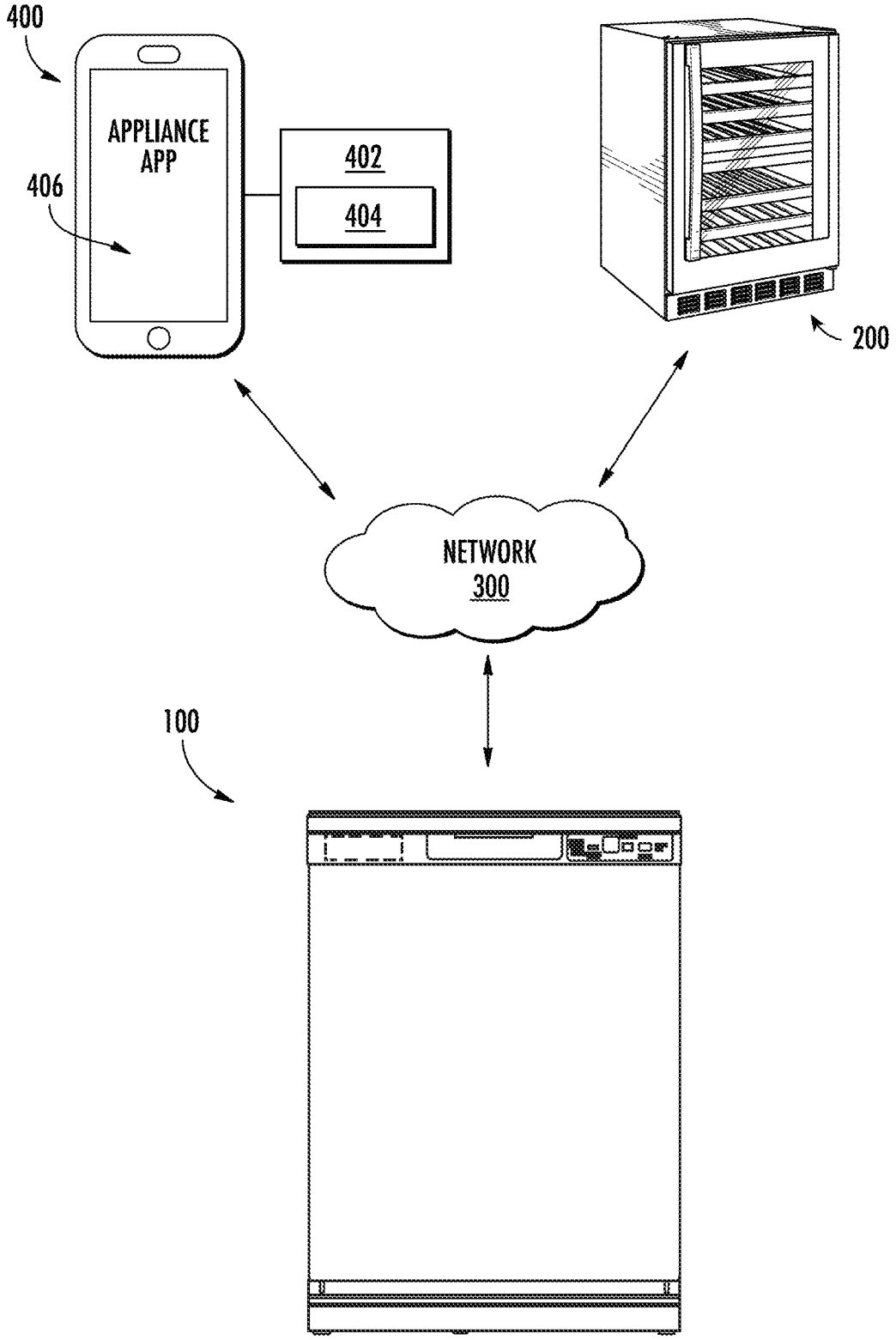
FIG. 6 provides a schematic view of an example network system in accordance with aspects of the present disclosure.

Turning now to FIG. 6, provided is a schematic view of a system 300 according to example embodiments of the present subject matter. As depicted, system 300 may include dishwashing appliance 100, one or more external devices, such as a user device 400, and refrigeration appliance 200. As shown, dishwashing appliance 100, user device 400, and refrigeration appliance 200 may be communicatively coupled with one another via a network 350. Network 350 may be any suitable type of network, such as a local area network (e.g., intranet), wide area network (e.g., internet), low power wireless networks, e.g., Bluetooth Low Energy (BLE), or some combination thereof, and may include any number of wired or wireless links. In general, communication over network 350 may be carried via any type of wired and/or wireless connection, using a wide variety of communication protocols (e.g., TCP/IP, HTTP, SMTP, FTP), encodings or formats (e.g., HTML, XML), and/or protection schemes (e.g., VPN, secure HTTP, SSL).

User device 400 may be communicatively coupled with or connected to the network 350. For instance, in some embodiments, user device 400 may connect to network 350 wirelessly or via a wired connection. User device 400 includes a processing device and/or controller 402, a communication interface 404, and a user interface 406. User device 400 may be any suitable type of electronic device connectable with network 350 and capable of presenting one or more alerts, notifications, communications, etc. For example, user device 400 may be a personal computing device (e.g., laptop or desktop), a mobile computing device (e.g., smartphone, tablet, smartwatch), a gaming console or controller, a wearable computing device, an embedded computing device, a remote, or any other suitable type of user device. For this embodiment, user device 400 is a smartphone. Although only one (1) user device is shown in FIG. 6, system 300 may include multiple or a plurality of user devices. Furthermore, in other example embodiments, user device 400 may be any suitable remote server, database, or cloud based system.

Controller 402 of user device 400 may include one or more processors and one or more memory devices and may provide user device 400 functionality. The processor(s) of controller 402 may be any suitable processing device, such as a microprocessor, microcontroller, integrated circuit, or other suitable processing device. The memory device(s) of controller 402 may include any suitable computing system or media, including, but not limited to, non-transitory computer-readable media, RAM, ROM, hard drives, flash drives, or other memory devices. The memory of controller 402 may store information accessible by processor(s) of controller 402, including instructions that may be executed by processor(s) of controller 402 in order to operate various components of user device 400 to provide user device 400 functionality. Controller 402 is communicatively coupled with various operational components of user device 400, such as e.g., user interface 406 and communication interface 404. User interface 406 of user device 400 may include a touch screen and/or one or more buttons. Input/output ("I/O") signals may be routed between controller 402, user interface 406, and communication interface 404 (as well as other operational components of user device 400), e.g., via an integrated control board of user device 400. Controller 402 may execute various applications, such as e.g., an "Appliance App", as shown in FIG. 6. The Appliance App may be specifically designed to control appliance 100 remotely, e.g., via network 350, and for presenting information relating to refrigeration appliance 200 and/or dishwashing appliance 100, such as notifications indicating suggestions for wash cycles of dishwashing appliance 100 based on the information relating to refrigeration appliance 200. More specifically, based on a characterization of a load within refrigeration appliance 200, user device 400 may present a notification indicating that a specific wash cycle may be desired, as will be further detailed herein.

Communication interface 404 of user device 400 is operable to communicatively couple or connect user device 400 with various networks, such as e.g., network 350. Communication interface 404 may include any suitable components for interfacing with one more networks. For example, communication interface 404 may include transmitters, receivers, ports, controllers, antennas, or other suitable components for interfacing with network 350 and/or other networks. Communication interface 404 may establish communication with a network in any suitable manner, e.g., via a wired or wireless communication link, and with any suitable protocol. Controller 402 may provide control functionality for communication interface 404.

Figure 7:
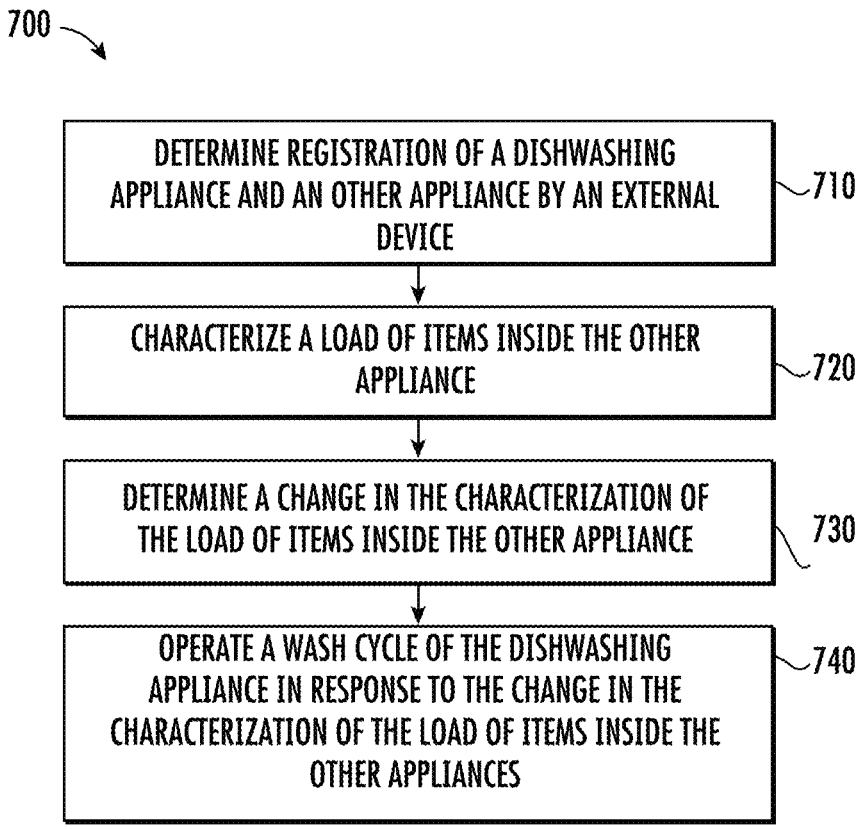
FIG. 7 provides a flowchart of an example method of operating a dishwashing appliance, such as the dishwashing appliance of FIG. 1 or FIG. 2.

Referring now to FIG. 7, a flow diagram of one embodiment of a method 700 of operating dishwashing appliance 100 is illustrated in accordance with aspects of the present subject matter. In general, method 700 will be described herein with reference to the embodiments of dishwashing appliance 100, refrigeration appliance 200, and system 300 described above with reference to FIGS. 1-6. However, it should be appreciated by those of ordinary skill in the art that the disclosed method 700 may generally be utilized in association with apparatuses and systems having any other suitable configuration, such as a refrigerator that includes a camera to identify which particular foods have been recently consumed, e.g., a camera-based refrigerator inventory system to determine a particular food was used. Or such as an oven appliance configured to detect casserole cookware. In addition, although FIG. 7 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 7, at (710), method 700 may generally include determining, by an external device, registration of an other appliance and the dishwashing appliance. In other words, at (710), method 700 may generally include the determination of whether or not the dishwasher appliance and the other appliance, such as dishwashing appliance 100 and refrigeration appliance 200, have been registered. For example, user device 400 may determine, e.g., through the Appliance App, the registration of dishwashing appliance 100 and refrigeration appliance 200. In other words, a user may input, into the Appliance App, information to register the product, such as a serial number or the like, linking the appliances 100, 200 to the Appliance App. Accordingly, user device 400 may determine that both appliances 100, 200 have been registered by the user and are linked to the Appliance App. In general, registering an appliance to an app, a website, or a manufacturer is understood by those skilled in the art and specific description thereof will be omitted for the sake of brevity.

At (720), method 700 may generally include characterizing a load of items inside the other appliance. The characterization of the load of items may occur by any suitable system (not shown) for counting, weighing, or scanning contents. For example, a camera system, scale, or any other suitable system may be provided in refrigeration appliance 200 in order to characterization of the load of items. In one example embodiment, the other appliance, e.g., refrigeration appliance 200, may be a wine cooler, where the load of items in the other appliance may be bottles of wine in the wine cooler. More specifically, characterizing the load of items inside the other appliance may include user device 400 receiving a first measurement from controller 230 of refrigeration appliance 200. For example, the first measurement may be a bottle count, such as an inventory count, or a weight of the load inside refrigeration appliance 200.

At (730), method 700 may generally include determining a change in the characterization of the load of items inside the other appliance. For example, the change in the characterization of the load of items may be a decrease in the load of items inside the wine cooler, such as a reduced number of wine bottles, and controller 402 of user device 400 may determine that this change has occurred. More specifically, user device 400 may compare the first measurement from controller 230 to a second measurement from controller 230, whereby in the present example scenario, the bottle count or weight of the load inside refrigeration appliance 200 may have decreased compared to the first measurement.

At (740), method 700 may generally include operating a wash cycle of the dishwashing appliance in response to the change in the characterization of the load of items inside the other appliance. In one example scenario, the user may activate dishwashing appliance 100 based on a suggested wash cycle from user device 400. In other words, user device 400 may suggest the wash cycle of dishwashing appliance 100 based on the change in characterization of the load of items in the other appliance. In another example scenario, the refrigeration appliance 200 may communicate to user device 400 that the load inside of refrigeration appliance 200 has reduced, e.g., one or more bottle(s) of wine may have been removed, thus user device 400 may communicate to dishwashing appliance 100 that operating a wash cycle for glassware may be advantageous.

For example, the wash cycle may include an optimized glass cycle configured to clean glassware. More specifically, the optimized glass cycle may include rinsing glassware with rinse aid additives. In response to rinsing glassware with rinse aid additives, method 700 may further include notifying a user via the external device, e.g., user device 400. Notifying the user may include transmitting a user notification to the external device and providing the notification on the external device in a manner that can be perceived, e.g., read or otherwise seen and/or heard, and understood by the user, that wash additives, such as rinse aids, should be added into dishwashing appliance 100. Furthermore, the optimized glass cycle may include spraying a specified volume of water from a spray assembly, such as spray assembly 134 or spray assembly 142, within dishwashing appliance 100. For example, the specified volume of water may be between one half of a gallon (0.5 gal) and four gallons (4 gal), such as between one gallon (1 gal) and three gallons (3 gal), such as between one and a half gallons (1.5 gal) and two and a half gallons (2.5 gal). Additionally, the optimized glass cycle may also include spraying heated water from the spray assembly, such as spray assembly 134 or spray assembly 142. Accordingly, method 700 may further include heating water to a specified temperature before spraying from the spray assembly, e.g., the water may be heated to the specified temperature between one hundred degrees Fahrenheit (100° F.) and one hundred and sixty degrees Fahrenheit (160° F.), such as between one hundred and ten degrees Fahrenheit (110° F.) and one hundred and fifty degrees Fahrenheit (150° F.), such as between one hundred and twenty degrees Fahrenheit (120° F.) and one hundred and forty degrees Fahrenheit (140° F.). Thus, the optimized glass cycle may include one or more of rinse aid additives, specified volumes of water, and/or specified temperature water in order to reduce soap/water spots or other blemishes on glassware.

Figure 8:
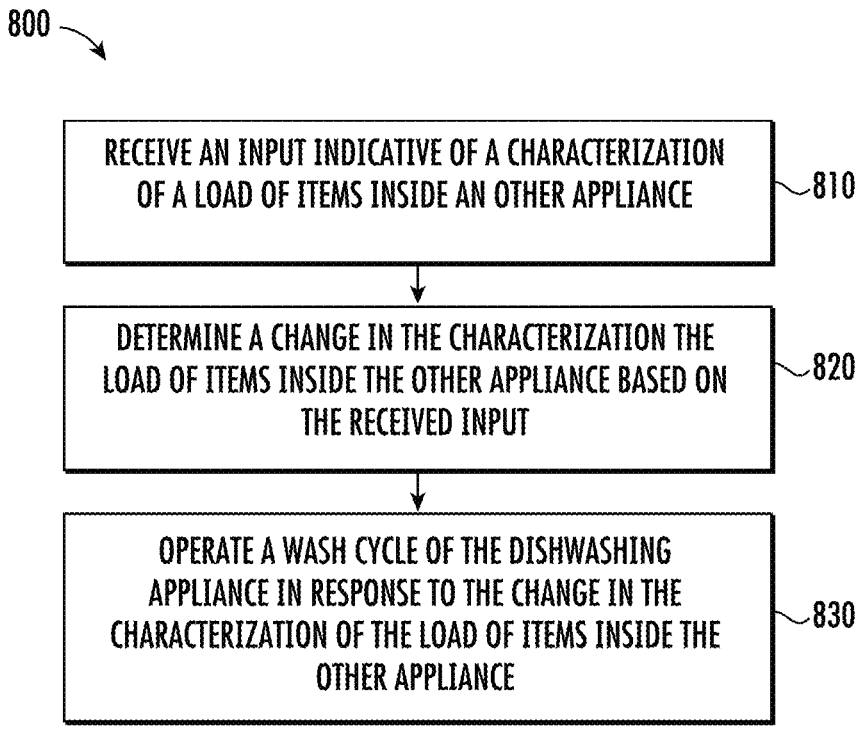
FIG. 8 provides a flowchart of another example method of operating a dishwashing appliance, such as the dishwashing appliance of FIG. 1 or FIG. 2.

Referring now to FIG. 8, a flow diagram of an embodiment of a method 800 of operating dishwashing appliance 100 is illustrated in accordance with aspects of the present subject matter. In general, method 800 will be described herein with reference to the embodiments of dishwashing appliance 100, refrigeration appliance 200, and system 300 described above with reference to FIGS. 1-6. However, it should be appreciated by those of ordinary skill in the art that the disclosed method 800 may generally be utilized in association with apparatuses and systems having any other suitable configuration. In addition, although FIG. 8 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 8, at (810), method 800 may generally include user device 400 receiving an input indicative of a characterization of a load of items inside an other appliance. The input may generally be a signal transmitted from the other appliance and read/interpreted by controller 402. In other words, user device 400 may receive, from the other appliance, e.g., refrigeration appliance 200, the characterization of the load of items inside the other appliance, such as bottles of wine within refrigerator appliance 200. In the present example embodiment, refrigeration appliance 200 may be a wine cooler, where the characterization of the load of items in the other appliance may be bottles of wine in the wine cooler.

At (820), method 800 may generally include determining a change in the characterization of the load of items inside the other appliance based on the received input. As explained in detail above, the change in the characterization of the load of items may be a decrease in the load of items inside refrigeration appliance 200, such as a reduced number of wine bottles. More specifically, the input indicative of the characterization of the load of items in the other appliance may be compared to a previous input received by user device 400.

At (830), method 800 may generally include operating a wash cycle of the dishwashing appliance in response to the change in the characterization of the load of items inside the other appliance. As described above with respect to method 700 at (740), the wash cycle at (830) may include the optimized glass cycle configured to clean glassware. As explained in detail above, the optimized glass cycle may include one or more of rinse aid additives, specified volumes of water, and/or specified temperature water in order to reduce soap/water spots or other blemishes on glassware.

In general, the present example embodiments illustrated in FIG. 1-8 may provide an advantageously improved dishwashing appliance 100 and improved methods of operating the improved dishwashing appliance 100. In particular, as seen in the above, characterizing a load of items inside one appliance in order to determine operation of a wash cycle in a dishwashing appliance, and operating the determined (optimized) wash cycle, e.g., specifically configured to provide specified temperatures and specified volumes of water for a cleaner and more efficient result than without, may be advantageous.

As may be seen from the above, a method of operating a dishwashing appliance may suggest a glassware/wine glass cycle in the dishwashing appliance in response to the likelihood that a user has wine glasses to wash. A mobile application may receive input and determine the dishwashing and the refrigeration appliance may be commissioned in the mobile application and may offer an optimized glass cycle that is dedicated to wine glasses in response to the refrigeration appliance detecting that the bottle count has decreased inside of the wine. Accordingly, this may indicate that the user likely has some wine glasses to wash. When a user takes a bottle of wine out from the refrigeration appliance, the count of wine bottles may be decreased, and the mobile application may suggest setting the dishwashing appliance glassware/wine glass wash cycle based on the decrement of wine bottle(s) in refrigeration appliance. In addition, the dishwashing appliance may communicate with the mobile application to remind users to add rinse aid additives to the dishwashing appliance before starting the cycle to advantageously help give the glassware/wine glasses a clean, shiny appearance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a dishwashing appliance, comprising:

determining, by an external device, registration of an other appliance and the dishwashing appliance;

characterizing a load of items inside the other appliance;

determining a change in the characterization of the load of items inside the other appliance; and operating a wash cycle of the dishwashing appliance in response to the change in the characterization of the load of items inside the other appliance, wherein the wash cycle comprises an optimized glass cycle configured to clean glassware.

2. The method of claim 1, wherein the other appliance is a wine cooler, wherein the change in the characterization of the load of items is a decrease in the load of items inside the wine cooler.

3. The method of claim 1, further comprising suggesting, by the external device, the wash cycle of the dishwashing appliance based on the change in characterization of the load of items in the other appliance.

4. The method of claim 1, wherein, during the optimized glass cycle, the method comprises rinsing glassware with rinse aid additives.

5. The method of claim 1, further comprising notifying, by the external device, to add wash additives into the dishwashing appliance.

6. The method of claim 1, wherein the optimized glass cycle comprises spraying a specified volume of water from a spray assembly.

7. The method of claim 1, wherein the optimized glass cycle comprises spraying heated water from a spray assembly, wherein the method further comprises heating water to a specified temperature before spraying from the spray assembly.

8. The method of claim 1, wherein characterizing the load of items inside the other appliance further comprises receiving, at the external device, a first measurement from a controller of the other appliance.

9. The method of claim 8, further comprising comparing, at the external device, the first measurement from the controller of the other appliance to a second measurement.

10. A method of operating a dishwashing appliance, comprising:

receiving, at an external device, an input indicative of a characterization of a load of items inside an other appliance;

determining a change in the characterization the load of items inside the other appliance based on the received input; and operating a wash cycle of the dishwashing appliance in response to the change in the characterization of the load of items inside the other appliance, wherein the wash cycle comprises an optimized glass cycle configured to clean glassware.

11. The method of claim 10, wherein the other appliance is a wine cooler, wherein the change in the characterization of the load of items is a decrease in the load of items inside the wine cooler.

12. The method of claim 10, further comprising suggesting, by the external device, the wash cycle of the dishwashing appliance based on the change in characterization of the load of items in the other appliance.

13. The method of claim 10, wherein, during the optimized glass cycle, the method comprises rinsing glassware with rinse aid additives.

14. The method of claim 13, further comprising notifying, by the external device, to add wash additives into the dishwashing appliance.

15. The method of claim 10, wherein the optimized glass cycle comprises spraying a specified volume of water from a spray assembly.

16. The method of claim 10, wherein the optimized glass cycle comprises spraying heated water from a spray assembly, wherein the method further comprises heating water to a specified temperature before spraying from the spray assembly.

17. The method of claim 10, wherein the characterization of the load of items inside the other appliance further comprises receiving, at the external device, a first measurement from a controller of the other appliance.

18. The method of claim 17, further comprising comparing, at the external device, the first measurement from the controller of the other appliance to a second measurement.

* * * * *